US006094560A

United States Patent [19]

Thomas

[11] Patent Number: 6,094,560

[45] Date of Patent: Jul. 25, 2000

[54] ELECTROPHOTOGRAPHIC PRINTING MACHINE INCLUDING A POST-FUSING SUBSTRATE MOISTURIZING AND DECURLING DEVICE

[75] Inventor: Kim M. Thomas, Colorado Springs, Colo.

[73] Assignee: Xerox Corporation, Stamford, Conn.

[21] Appl. No.: 09/366,970

[22] Filed: Aug. 4, 1999

Related U.S. Application Data

[60] Provisional application No. 60/109,990, Nov. 25, 1998.

[51] Int. Cl.[7] ..... G03G 15/20; G03G 21/00

[52] U.S. Cl. ..... 399/341; 162/271; 399/406; 430/97

[58] Field of Search ..... 399/341, 406, 399/407, 320, 397; 219/216; 430/97; 118/58, 66, 69; 101/147; 162/197, 270, 271

[56] References Cited

U.S. PATENT DOCUMENTS

| | | | |
|---|---|---|---|
| 4,375,327 | 3/1983 | Matsumoto et al. | 399/323 |
| 4,652,110 | 3/1987 | Sato et al. | 399/406 |
| 5,434,029 | 7/1995 | Moser | 430/97 |
| 5,557,388 | 9/1996 | Creutzmann et al. | 399/320 X |
| 5,933,694 | 8/1999 | Yamashita et al. | 399/406 X |

FOREIGN PATENT DOCUMENTS

| | | |
|---|---|---|
| 7-056455 | 3/1995 | Japan . |

*Primary Examiner*—Sophia S. Chen
*Attorney, Agent, or Firm*—Tallam I. Nguti

[57] ABSTRACT

A moisturizing and decurling apparatus, mountable immediately downstream of a fusing apparatus in an electrostatographic reproduction machine, is provided for removing any curl from a copy sheet in order to produce a high quality toner particle image of an original image on a stable flat copy sheet. The moisturizing and decurling apparatus includes a moisturizing device for applying moisture onto a copy sheet within a critical period of time after the copy sheet passes through the fusing apparatus, and a constraining and stabilizing assembly for constraining and stabilizing the copy sheet into a desired flat condition before the melted toner particles cool below a set critical temperature. The constraining and stabilizing assembly includes a flat vacuum belt assembly for holding flat and transporting the copy sheet before the melted toner particles cool below the set critical temperature.

9 Claims, 3 Drawing Sheets

ELECTROPHOTOGRAPHIC PRINTING MACHINE INCLUDING A POST-FUSING SUBSTRATE MOISTURIZING AND DECURLING DEVICE

This Application is based on a Provisional Application No. 60/109,990, filed Nov. 25, 1998.

BACKGROUND OF THE INVENTION

This invention relates generally to electrophotographic printing machines, and more particularly concerns such a machine including a post-fusing substrate moisturizing and decurling device.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles on the copy sheet are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, re-imaged and developed for each color separation. This charging, imaging, developing and recharging, re-imaging and developing, all followed by transfer to paper, is done in a single revolution of the photoreceptor in so-called single pass machines, while multipass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal.

One problem associated with moisture loss in paper is paper curl or waviness. As sheets pass through the fixing system, moisture is driven out and the sheet temperature is elevated. If after fixing, the sheet is then allowed to rest in a collection area fully exposed to its ambient surroundings, its moisture content will equilibrate with the environment through absorption of moisture across the full face of at least one side of the paper sheet. If, however, the copy sheet becomes part of a large compiled set, both sides of all of the papers in the compilation (except for the top sheet) will effectively be sealed off from the moisture within the atmosphere. The only route available to this desiccated paper for moisture re-absorption is through the edges of the sheets, leaving the moisture content of the central portions of the sheets relatively unchanged. This uneven pattern of moisture re-absorption results in edge stresses that lead to paper curl or waviness along the edges of the paper. The resulting wave pattern may typically have an amplitude of ⅛ inch to ¼ inch.

In addition to being cosmetically unsightly, the edge wave or curl creates a secondary handling problem, in that pages having such a wave pattern along their edges are more difficult to feed to secondary paper handling machines, such as a binder apparatus. For this reason, printers continue to favor the use of offset presses, for large compilations.

Conventional decurlers have relied primarily upon bending the copy sheet after fusing in order to counteract the effects of curl. Ordinarily, conventional decurlers do not take into account the moisture lost from the paper during the fusing process nor time and other factors that change after or post fusing.

A number of solutions to this problem have been advanced. One proposed solution is to use an offset press dampening system to add moisture to each sheet as it exits the copier. These systems typically rely on the generation of a pool of water at a roll interface to distribute the water evenly along the rolls. Such systems usually operate with a web paper supply and their use with a cut sheet feeder system creates some difficulties not previously contemplated or addressed. Normal dampening systems are more appropriate for use with conventional offset presses.

U.S. Pat. No. 4,375,327 attempts to solve the problem of wave curling as it arises due to another cause: adherence of paper to a roller fixing device and does not address the problem caused by moisture loss. U.S. Pat. No. 4,652,110 (the contents of which are hereby incorporated by reference) attempts to replenish moisture lost in the fixing process by collecting moisture as it is driven off the copy sheet for reapplication to the sheet at a later time.

There remains a need for a system for preventing the edge curl or waviness caused by the loss of moisture from the copy sheet during the fixing step of electrostatographic reproduction or printing, as well as by other changing factors after the fusing or fixing step.

SUMMARY OF THE INVENTION

In accordance with the present invention, there is provided a moisturizing and decurling apparatus, mountable immediately downstream of a fusing apparatus in an electrostatographic reproduction machine, for removing any curl from a copy sheet in order to produce a high quality toner particle image on a stable flat copy sheet. The moisturizing and decurling apparatus includes a moisturizing device for applying moisture onto a copy sheet within a critical period of time after the copy sheet passes through the fusing apparatus, and a constraining and stabilizing assembly for constraining and stabilizing the copy sheet into a desired flat condition before the melted toner particles cool below a set critical temperature. The constraining and stabilizing assembly includes a flat vacuum belt assembly for holding flat and transporting the copy sheet before the melted toner particles cool below the set critical temperature.

BRIEF DESCRIPTION OF THE DRAWINGS

These and other aspects of the present invention will become apparent from the following description in conjunction with the accompanying drawings in which.

DETAILED DESCRIPTION OF THE INVENTION

Figure 1:
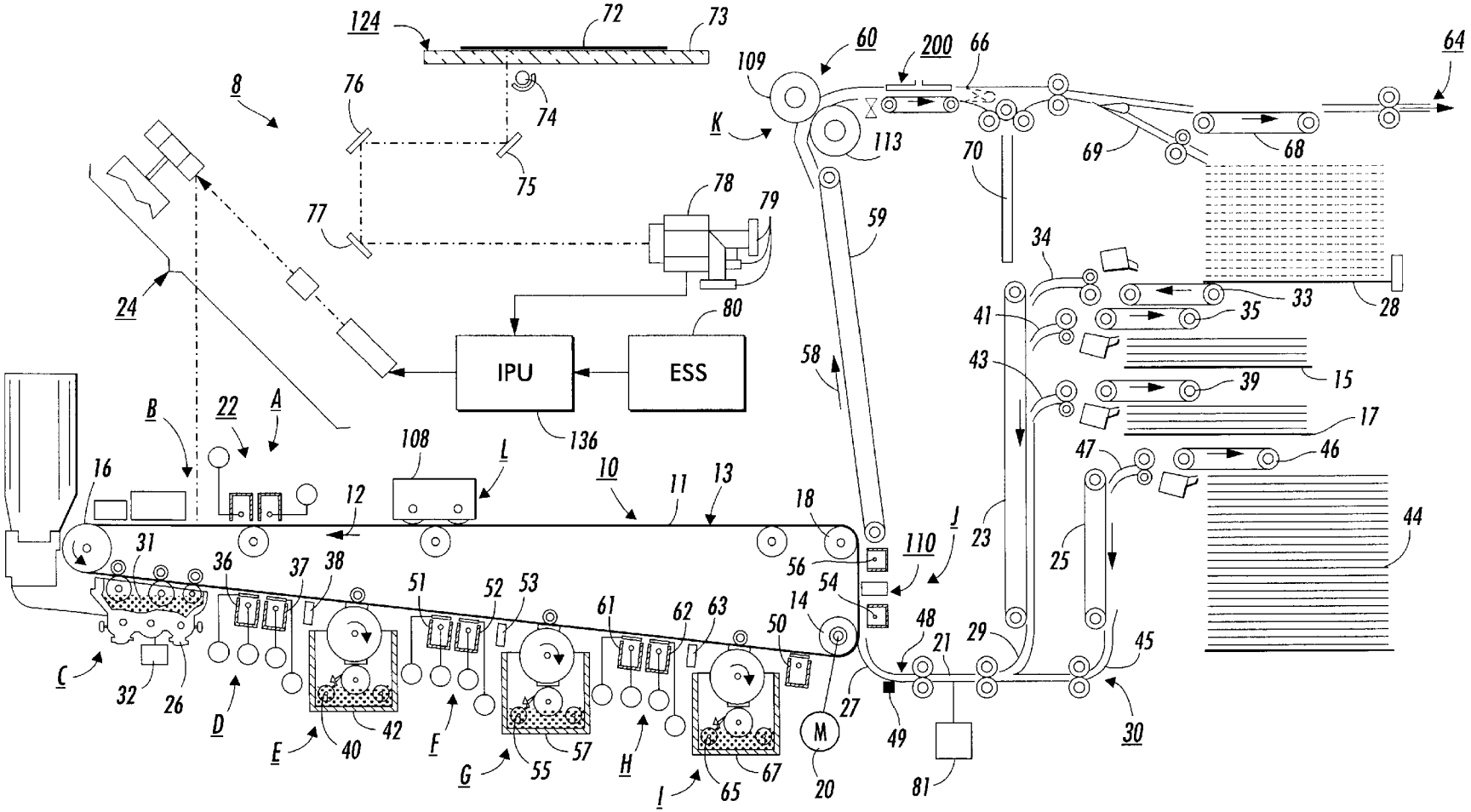
FIG. 1 is a schematic illustration of an exemplary image-on-image color printing machine incorporating the moisturizing and decurling apparatus in accordance with the present invention.

For a general understanding of the features of the present invention, reference is made to the drawings, wherein like reference numerals have been used throughout to identify the same or similar elements. Although the following description will be directed to an image-on-image color printing machine, it will be understood that the present invention contemplates the use of various alternative embodiments, including black and white printing machines. On the contrary, the following description is intended to cover all alternatives, modifications, and equivalents, as may be included within the spirit and scope of the invention as defined by the appended claims.

Referring to FIG. 1, there is depicted an exemplary image-on-image printing machine 8. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80.

The ESS is preferably a self-contained, dedicated mini-computer having a central processor unit (CPU), electronic storage, and a display or user interface (UI). The ESS is the control system which prepares and manages the image data flow between IPU 136 and image input terminal 124, as well as being the main multi-tasking processor for operating all of the other machine subsystems and printing operations. The printing operations include imaging, development, sheet delivery and transfer, and the moisturizing and decurling apparatus in accordance with the present invention (to be described in detail hereinafter), as well as various functions associated with subsequent finishing processes. Some or all of these subsystems may have micro-controllers that communicate with the ESS 80.

The printing machine 8 employs a photoreceptor 10 in the form of a belt having a photoconductive surface layer 11 on an electroconductive substrate 13. Preferably the surface 11 is made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counter-clockwise direction as shown by arrow 12.

Initially, the photoreceptor 10 passes through charging station A where a corona generating device, indicated generally by the reference numeral 22, charges photoreceptor 10 to a relatively high, substantially uniform potential. Next, the charged portion of photoreceptor 10 is advanced through an imaging station B. At imaging station B, the uniformly charged belt 10 is exposed to the scanning device 24 which causes the photoreceptor to be discharged in accordance with the output from the scanning device. The scanning device is a laser Raster Output Scanner (ROS). The ROS creates the image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station C, a magnetic brush developer unit, indicated generally by the reference numeral 26 advances developer material 31 into contact with the latent image and latent target marks. Developer unit 26 has a plurality of magnetic brush roller members. These magnetic brush rollers transport negatively charged black toner material to the latent image for development thereof. Power supply 32 electrically biases developer unit 26.

At recharging station D, a pair of corona recharge devices 36 and 37 are employed for adjusting the voltage level of both the toned and untoned areas on photoreceptor 10 to a substantially uniform level. A power supply is coupled to each of the electrodes of corona recharge devices 36 and 37. Recharging devices 36 and 37 substantially eliminate any voltage difference between toned areas and bare untoned areas, as well as to reduce the level of residual charge remaining on the previously toned areas, so that subsequent development of different color toner images is effected across a uniform development field.

Imaging devices 38, 53, and 63 are used to superimpose subsequent images by selectively discharging the recharged photoreceptor. These imaging devices may include, for example, a LED image array bar, or another ROS. On skilled in the art will appreciate that the operation of imaging devices 38, 53, and 63 are also controlled by ESS 80. Moreover, one skilled in the art will recognize that those areas developed with black toner will not be subjected to sufficient light from the imaging devices to discharge the photoreceptor region lying below the black toner particles. However, this is of no concern as there is little likelihood of a need to deposit other colors over the black regions.

Imaging device 38 records a second electrostatic latent image on photoreceptor 10. A negatively charged developer material 40, for example, one including yellow toner, develops the second latent image. The toner is contained in a developer unit 42 disposed at a second developer station E and is transported to the second latent image recorded on the photoreceptor by a donor roll. A power supply (not shown) electrically biases the developer unit to develop this latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

At a second recharging station F, a pair of corona recharge devices 51 and 52 are employed for adjusting the voltage level of both the toned and untoned areas on photoreceptor 10 to a substantially uniform level. A power supply is coupled to each of the electrodes of corona recharge devices 51 and 52. The recharging devices 51 and 52 substantially eliminate any voltage difference between toned areas and bare untoned areas, as well as to reduce the level of residual charge remaining on the previously toned areas so that subsequent development of different color toner images is effected across a uniform development field. A third latent image is then recorded on photoreceptor 10 by imaging device 53. This image is developed using a third color toner 55 contained in a developer unit 57 disposed at a third developer station G. An example of a suitable third color toner is magenta. Suitable electrical biasing of the developer unit 57 is provided by a power supply, not shown.

At a third recharging station H, a pair of corona recharge devices 61 and 62 adjust the voltage level of both the toned and untoned areas on photoreceptor 10 to a substantially uniform level. A power supply is coupled to each of the electrodes of corona recharge devices 61 and 62. The recharging devices 61 and 62 substantially eliminate any voltage difference between toned areas and bare untoned areas as well as to reduce the level of residual charge remaining on the previously toned areas, so that subsequent development of different color toner images is effected across a uniform development field A fourth latent image is created using imaging device 63. The fourth latent image is formed on both bare areas and previously toned areas of photoreceptor 10 that are to be developed with the fourth color image. This image is developed, for example, using a cyan color toner 65 contained in developer unit 67 at a fourth developer station 1. Suitable electrical biasing of the developer unit 67 is provided by a power supply, not shown.

Developer units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein.

In order to condition the toner for effective transfer to a substrate, a negative pre-transfer corotron member 50 negatively charges all toner particles to the required negative polarity to ensure proper subsequent transfer.

During the exposure and development of the color image on the photoconductor, a sheet of support material is advanced to transfer station J by a sheet feeding apparatus 30. During simplex operation (single sided copy), a blank sheet may be fed from tray 15 or tray 17, or a high capacity tray 44 thereunder, to a registration transport 21, in communication with controller 81, where the sheet is registered in the process and lateral directions, and for skew position. One skilled in the art will realize that trays 15, 17, and 44 each hold a different sheet type. The speed of the sheet is adjusted at registration transport 21 so that the sheet arrives at transfer station J in synchronization with the image on the surface of photoconductive belt 10. Registration transport 21 receives a sheet from either a vertical transport 23 or a high capacity tray transport 25 and moves the received sheet to a pretransfer baffle 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets from tray 44 to transport 25 by a chute 47.

The pretransfer baffle 27 guides the sheet from the registration transport 21 to transfer station J. Charge limiter 49 located on pretransfer baffle 27 restricts the amount of electrostatic charge a sheet can place on the baffle 27 thereby reducing image quality problems and shock hazards. The charge can be placed on the baffle from either the movement of the sheet through the baffle or by the corona generating devices located at transfer station J. When the charge exceeds a threshold limit, charge limiter 49 discharges the excess to ground.

Transfer station J includes a transfer corona device 54 which provides positive ions to the backside of the copy sheet. This attracts the negatively charged toner powder images from photoreceptor belt 10 to the sheet. A detack corona device 56 is provided for facilitating stripping of the sheet from belt 10.

A sheet-to-image registration detector 110 is located in the gap between the transfer and corona devices 54 and 56 to sense variations in actual sheet to image registration and provides signals indicative thereof to ESS 80 and controller 81 while the sheet is still tacked to photoreceptor belt 10. After image transfer, and after the sheet of support material is separated from photoreceptor 10, residual toner carried on the photoreceptor surface is removed at cleaning station L using a cleaning brush structure contained in a unit 108. Meanwhile, the sheet after separating from the photoreceptor, continues to move, in the direction of arrow 58, onto a conveyor 59 that advances the sheet to fusing station K.

Fusing station K includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder or particle image contacting fuser roller 109. In this manner, the multi-color toner particle image is permanently fixed to the sheet.

After passing through the fusing station, the sheet with the fused toner particle image thereon is moisturized and decurled by the moisturizing and decurling apparatus 200 into a flat condition in accordance with the present invention (to be described below). A chute 66 then guides the advancing decurled sheet to a feeder 68 for exit via output 64, to a finishing module (not shown). However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station J, in the same manner as the image was deposited on the first side thereof. The completed duplex copy exits to the finishing module (not shown) via output 64.

Figure 2:
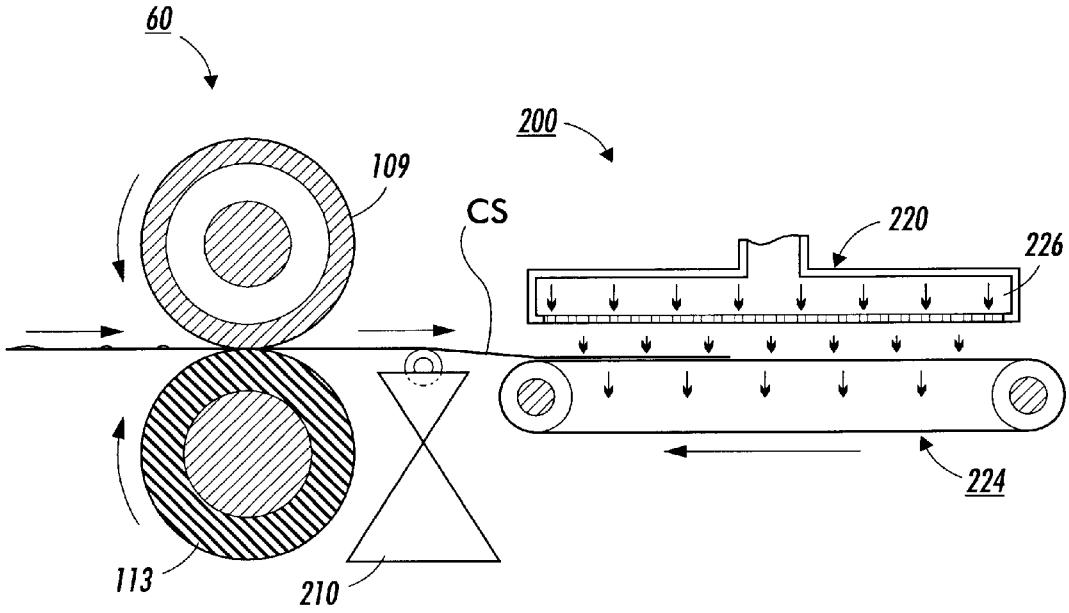
FIG. 2 is a detailed illustration of the moisturizing and decurling apparatus of FIG. 1 in accordance with the present invention.
Figure 3:
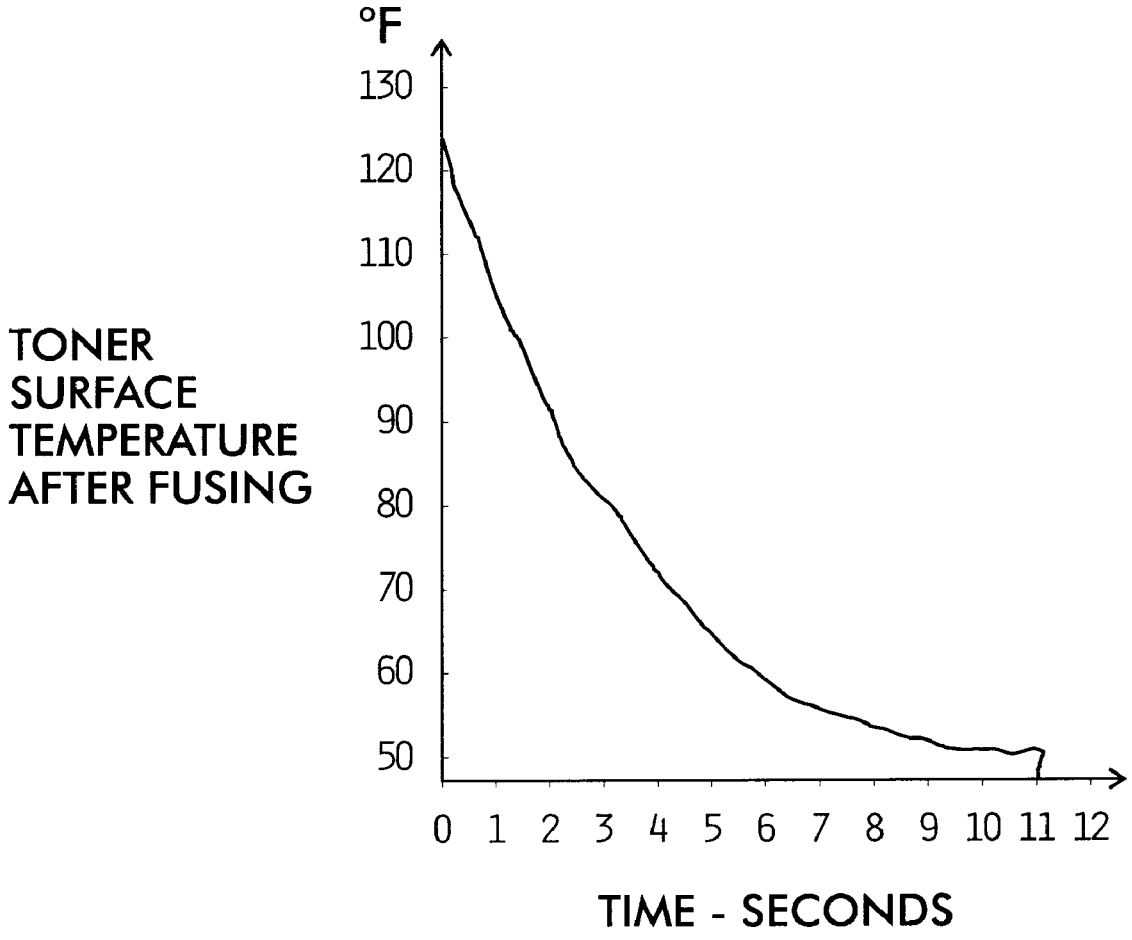
FIG. 3 is a graphical illustration of the temperature profile of a fused sheet immediately after fusing.

Referring now to FIGS. 1, 2 and 3, the moisturizing and decurling apparatus 200 of the present invention is illustrated in detail (FIG. 2), as well as aspects of its performance (FIG. 3). As shown in FIG. 1, the apparatus 200 is mountable immediately downstream of a fusing apparatus 60 in the electrostatographic reproduction machine 8, for removing any curl from a copy sheet CS in order to produce a high quality toner particle image of an original image on a stable flat copy sheet. The moisturizing and decurling apparatus 200 includes a moisturizing device 210 for applying moisture onto preferably the backside of the copy sheet CS and within a critical period of time (less than 8 seconds and preferably about 4 seconds) after the copy sheet passes through the fusing apparatus 60. The moisturizing device 210 should be controlled to apply moisture only to an amount sufficient to replace moisture lost due to heat from the fusing apparatus 60. In addition to the toner particles forming the image melting on the page, it has been found that as a copy sheet of paper travels through the fuser or fusing apparatus 60, it can lose up to 30% of its moisture, which is a considerable amount of moisture amounting to approximately 1–4% of the copy sheet by volume. This causes the sheet of paper to shrink from the moisture loss Importantly in accordance with the present invention, the moisturizing device 210 adds moisture to the paper as soon as possible upon the sheet of paper exiting the nip of the fuser 60. This is important because moisture re-absorption by the sheet of paper is a time dependent process. As such, moisture addition must take place as soon as possible (within 8 seconds, and preferably about 4 seconds) in order to enable re-absorption as well as allow the paper to grow back to its original size before the toner particles reach their glass transition temperature Tg. This allows the toner and the paper to freely come to a sort of size equilibrium where the fusing temperature of the fusing apparatus 60 is about 120–130 degrees centigrade, it has been found that such toner particles will reach their glass transition temperature in about 8 seconds.

As further shown, the moisturizing and decurling apparatus 200 also includes a constraining and stabilizing assembly 220 for constraining and stabilizing the copy sheet CS into a desired flat condition before the melted toner particles cool below a set critical temperature, their glass transition temperature. As illustrated, the constraining and stabilizing assembly 220 includes a flat vacuum belt assembly 224 for holding flat and transporting the copy sheet CS before the melted toner particles cool below the glass transition temperature. The constraining and stabilizing assembly 220 also includes a cooling device 226 for controllably cooling the toner particles and copy sheet after remoisturization and while constrained onto the flat vacuum belt assembly 224 by a vacuum source thereof. Therefore, after moisture is added immediately by the moisturizer 210 in order to rapidly bring the shrunk copy sheet back into equilibrium with the environment, the copy sheet is constrained flat for example by the vacuum transport belt assembly 224. The moisture lost from paper during the fusing process is replenished in a constrained configuration. By constraining the copy sheet during the remoisturization step, this prevents paper curl. The copy sheet is then rapidly cooled by the cooling device 226 in order to "freeze" the toner into this flat position.

Thus, the apparatus 200 of the present invention takes into account the moisture lost from the sheet of paper during the fusing process as well as the time period it takes the melted toner to become a solid. Accordingly, the apparatus 200 only adds the moisture lost during the fusing process back into the paper, and then locks or constrains the copy sheet into its desired final position (flat) on the belt assembly 224, before the toner reaches the glass transition temperature (Tg). The copy sheet is then cooled in this flat position to room temperature by the cooling device 226.

As can be seen, there has been provided a moisturizing and decurling apparatus, mountable immediately downstream of a fusing apparatus in an electrostatographic reproduction machine, for removing any curl from a copy sheet in order to produce a high quality toner particle image of an original image on a stable flat copy sheet. The moisturizing and decurling apparatus includes a moisturizing device for applying moisture onto a copy sheet within a critical period of time after the copy sheet passes through the fusing apparatus, and a constraining and stabilizing assembly for constraining and stabilizing the copy sheet into a desired flat condition before the melted toner particles cool below a set critical temperature. The constraining and stabilizing assembly includes a flat vacuum belt for holding flat and transporting the copy sheet before the melted toner particles cool below the set critical temperature.

I claim:

1. An electrostatographic reproduction machine for producing a high quality toner particle image of an original image on a copy sheet, the reproduction machine comprising:

(a) a movable image bearing member mounted drivably to a frame, said image bearing member having an image bearing surface defining a path of movement thereof;

(b) electrostatographic imaging elements mounted at various distributed locations along said path of movement for forming the toner particle image onto said image bearing surface;

(c) transfer means for transferring the toner particle image onto the moving copy sheet;

(d) a fusing apparatus mounted downstream of the transfer means relative to a direction of movement of the copy sheet, for applying heat to the copy sheet and to the toner particle image thereon, so as to fuse such toner image onto the copy sheet, said fusing apparatus due to the heat applied, melting toner particles forming the toner particle image, and reducing a moisture content of the copy sheet, thereby inducing a curl in the copy sheet; and (e) a moisturizing and decurling apparatus mounted immediately downstream of said fusing apparatus for removing any curl from the copy sheet in order to produce a high quality toner particle image of the original image on a copy sheet, said moisturizing and decurling apparatus including means for applying moisture onto the copy sheet within a critical period of time after fusing, and means for constraining and stabilizing the copy sheet into a desired flat condition before the melted toner particles cool below a set critical temperature, said means for constraining and stabilizing the copy sheet including a flat vacuum transport belt assembly for transporting while holding the copy sheet flat.

2. The electrostatographic reproduction machine of claim 1, wherein said means for applying moisture onto the copy sheet applies moisture within 8 seconds after fusing.

3. The electrostatographic reproduction machine of claim 1, wherein said means for applying moisture onto the copy sheet applies moisture to a backside of the copy sheet.

4. The electrostatographic reproduction machine of claim 1, wherein said means for stabilizing the copy sheet includes a flat vacuum transport belt for transporting while holding the copy sheet flat, and a cooling device for controllably reducing a temperature of the melted toner particles.

5. The electrostatographic reproduction machine of claim 1, wherein said means for stabilizing the copy sheet includes a cooling device and the flat vacuum transport belt assembly for cooling, holding flat, and transporting the copy sheet and toner particle image, so as to stabilize the copy sheet and toner particle image into a desired flat condition before the melted toner particles cool below a glass transition temperature for the toner particles.

6. A moisturizing and decurling apparatus, mountable immediately downstream of a fusing apparatus in an electrostatographic reproduction machine, for removing any curl from a copy sheet in order to produce a high quality toner particle image of an original image on a copy sheet, the moisturizing and decurling apparatus comprising:

(a) means for applying moisture onto the copy sheet within a critical period of time after passing through the fusing apparatus; and (b) constraining and stabilizing means for constraining and stabilizing the copy sheet into a desired flat condition before the melted toner particles cool below a set critical temperature, said constraining and stabilizing means including a flat vacuum belt assembly for holding flat and transporting the copy sheet before the melted toner particles cool below the set critical temperature.

7. The moisturizing and decurling apparatus of claim 6, wherein said means for applying moisture onto the copy sheet is mounted relative to the fusing apparatus so that it applies moisture to the copy sheet within 8 seconds after fusing.

8. The moisturizing and decurling apparatus of claim 6, wherein said means for applying moisture onto the copy sheet is mounted so as to apply moisture to a backside of the copy sheet.

9. The moisturizing and decurling apparatus of claim 6, wherein said means for constraining and stabilizing the copy sheet includes a cooling device and the flat vacuum transport belt assembly for cooling, holding flat, and transporting the copy sheet and toner particle image, so as to stabilize the copy sheet and toner particle image into the desired flat condition before the melted toner particles cool below a glass transition temperature for the toner particles.

* * * * *